US008858284B2

(12) United States Patent
Sahun et al.

(10) Patent No.: US 8,858,284 B2
(45) Date of Patent: Oct. 14, 2014

(54) APPARATUS FOR AQUATIC EXERCISE

(75) Inventors: Stephan Sahun, Saint Pee sur Nivelle (FR); Patrick Doby, Attiches (FR); Damien Saumureau, Ciboure (FR); Francois Barbier, Hendaye (FR); Benoit Lefrancois, Rouen (FR)

(73) Assignee: Decathlon, Villeneuve d'Ascq (FR)

( * ) Notice: Subject to any disclaimer, the term of this patent is extended or adjusted under 35 U.S.C. 154(b) by 637 days.

(21) Appl. No.: 12/863,908

(22) PCT Filed: Jan. 21, 2009

(86) PCT No.: PCT/FR2009/050079

§ 371 (c)(1),
(2), (4) Date: Oct. 8, 2010

(87) PCT Pub. No.: WO2009/095582

PCT Pub. Date: Aug. 6, 2009

(65) Prior Publication Data

US 2011/0021324 A1 Jan. 27, 2011

(30) Foreign Application Priority Data

Jan. 21, 2008 (FR) ..... 08 50365

(51) Int. Cl.

| | |
|---|---|
| ***A63B 31/00*** | (2006.01) |
| ***A63B 23/035*** | (2006.01) |
| ***A63B 21/00*** | (2006.01) |
| ***A63B 31/14*** | (2006.01) |
| ***A63B 31/10*** | (2006.01) |
| ***A63B 21/008*** | (2006.01) |

(52) U.S. Cl.

CPC ..... *A63B 21/0084* (2013.01); *A63B 2209/00* (2013.01); *A63B 2210/50* (2013.01); *A63B 23/03508* (2013.01); *A63B 21/143* (2013.01); *A63B 31/14* (2013.01); *A63B 31/10* (2013.01); *A63B 21/1434* (2013.01)

USPC ..... 441/55; 441/64

(58) Field of Classification Search

USPC ..... 441/55, 64

IPC ..... A63B 31/08,31/10, 31/11, 31/12

See application file for complete search history.

(56) References Cited

U.S. PATENT DOCUMENTS

| | | | | |
|---|---|---|---|---|
| 1,545,807 | A | 7/1925 | Ajello | |
| 4,509,744 | A | 4/1985 | Beasley | |
| 4,685,667 | A | 8/1987 | McDonald | |
| 5,651,710 | A | 7/1997 | Rives et al. | |
| 6,540,647 | B2 | 4/2003 | Spooner et al. | |
| 6,899,581 | B1 | 5/2005 | Nokes | |
| 7,086,916 | B2 * | 8/2006 | Godoy | 441/64 |
| 7,147,526 | B1 | 12/2006 | Chiang | |
| 2004/0259691 | A1 | 12/2004 | Stout et al. | |

FOREIGN PATENT DOCUMENTS

| | | |
|---|---|---|
| EP | 1 498 159 A1 | 1/2005 |
| FR | 739070 | 1/1933 |
| FR | 1011324 | 6/1952 |
| FR | 1049110 | 12/1953 |
| FR | 1502877 | 11/1967 |
| FR | 2 537 876 A1 | 6/1984 |
| GB | 386211 | 1/1933 |
| WO | 2004/112910 A2 | 12/2004 |

OTHER PUBLICATIONS

International Search Report: PCT/FR2009/050079, May 2010.

* cited by examiner

*Primary Examiner* — Stephen Avila

(74) *Attorney, Agent, or Firm* — Ladas & Parry LLP

(57) ABSTRACT

An aquatic exercise device comprising a base arranged to be held in particular with a foot or with a hand, and webbing, in particular corolla-shaped webbing, that is secured to the base and that is suitable for deforming under pressure from the water that is exerted while the device is moving.

20 Claims, 3 Drawing Sheets

APPARATUS FOR AQUATIC EXERCISE

FIELD OF THE INVENTION

The present invention relates to an aquatic exercise device. It also relates to an aquatic exercise kit made up of said device and of a shoe suitable for being secured thereto for the purpose of fastening it to a foot of the user. The present invention is applicable to exercising and doing gymnastics in swimming pools. It is for selling in sports equipment stores and it is for manufacture by sports equipment manufacturers and/or plastics industry manufacturers who manufacture, in particular, products made of injection-molded polymer materials.

BACKGROUND

Devices for aquatic exercise or water gymnastics are in frequent use. They enable harder work to be performed when exercising in water and when pushing or pulling with a limb of the body, in particular with a leg or an arm. For this purpose, such a device that is known to the person skilled in the art has a base arranged to be held with said limb of the body, in particular a foot or a hand, or indeed a calf or a forearm.

The purpose of such an aquatic exercise device is to increase resistance when pushing or pulling with the leg or with the arm in order to make the physical or muscular work harder, and then, on the contrary, not to make it harder for the limb to return to its initial position for starting a new work cycle, by limiting the effort that the user needs to make during the return stroke so as to afford the user a recovery time and so as to avoid physical or muscular fatigue.

Various devices for aquatic exercise are known to the person skilled in the art, such as, for example, the devices disclosed in Documents U.S. Pat. Nos. 5,651,710, 6,899,581, 7,147,526, 4,685,667, 4,509,744, US 2004/0259691, WO 2004/112910, U.S. Pat. No. 6,540,647, EP 1 498 159, FR 739 070, FR 1 049 110, FR 1 502 877, FR 2 537 876.

Documents U.S. Pat. No. 4,685,667 and U.S. Pat. No. 6,899,581 disclose devices for aquatic exercise that are in the form of a disk provided with a base at its centre for enabling the disk to be held in the hand. In Documents U.S. Pat. No. 5,651,710 and U.S. Pat. No. 7,147,526, the aquatic exercise device is in the form of a paddle including a base enabling said paddle to be held in the hand, or indeed enabling the hand to be inserted into it in the manner of a hand wearing a glove, said paddle possibly having curved shapes and orifices, in particular, for facilitating the flow of fluid so as to limit the resistance of the device when exercising and when pushing or pulling with the arms. In Documents US 2004/0259691 and WO 2004/112910, the device is constituted by an element of rounded shape, in the form a dome-shaped or semi-spherical bell provided with a base enabling said device to be held. The dome-shaped bell is provided with perforations for reducing the resistance of the device and for stabilizing it while it is being moved through the water, and flat elements or rigid fins increasing the resistance of the appliance when pushing with the arm. In Document U.S. Pat. No. 4,509,744, the device is in the form of a bat or paddle provided with a base for enabling said bat to be held, the bat being slightly deformable so as to reduce the resistance of the bat while the device is returning to its initial position after an effort has been made.

Such aquatic exercise devices suffer from the drawback of requiring considerable effort to be sustained while the device is returning in the water to its initial position for doing a new work cycle, due to the rigidity of said device, the paddles, bats, flat elements or fins that are rigid or possibly slightly deformable, maintain considerable resistance in the water during the return stroke to the initial position. The person doing the exercise therefore has almost no recovery time, and must continue directly with the next work cycle. In addition, such devices offer little or no stability during the return strokes.

Documents EP 1 498 159 and U.S. Pat. No. 6,540,647 disclose aquatic exercise devices having a base that enables the device to be held with the hand or with the foot, and relative to which one or more paddles are hinged by means of mechanical hinges, the paddle(s) offering resistance in the water while the arm or the leg is moving, and then collapsing during the return stroke of the limb for returning to do a new exercise cycle. Such a design of a device equipped with mechanical hinges can give rise to pinching on the body of the user when said user makes a movement with the device and positions the mechanical hinge or the adjacent edges of two paddles in contact with a portion of the body at the time of pushing or pulling on the device that opposes resistance, i.e. when the paddles are deployed. In addition, the paddles can be deployed independently of one another and give rise to problems of stability or poor distribution of the effort while the device is moving in the water.

Documents FR 739 070, FR 1 049 110, FR 1 502 877 and FR 2 537 876 disclose aquatic exercise devices having a base designed to be held with the hand or with the foot, or indeed to be disposed around the ankle or the leg. In addition, such devices have a skirt or flexible webbing that is corolla-shaped, that is secured to the base, and that is suitable for deforming under the pressure from the water exerted while the device is moving, i.e. while it is being pushed or pulled. When the device is provided with flexible webbing, said webbing comprises metal reinforcements or slats extending radially from the base to the outside end of the skirt, these reinforcements or slats making it possible to stiffen the skirt when it is deployed, and when it opposes resistance in the water, i.e. when the corolla opens. In that design, the reinforcements or slats might deform and the webbing might turn inside out when pressure that is too high is exerted on said webbing.

In devices having skirts that are more rigid and that are provided with ribs, such as those described in FR 2 537 876, the skirts collapse at said ribs while the arm or the leg is returning to its initial position after having pushed or pulled on the device that opposes resistance. In that design, the user might be pinched while preparing to do a new work cycle, while the skirt is redeploying and is positioned in contact with a portion of the body, giving rise to a risk of the skin being pinched in said rib on the skirt. In addition, the design of the skirt suffers from the drawback of not collapsing uniformly around the limb when it collapses at the ribs while the device is returning to its initial position, during which return stroke the device maintains considerable resistance and can swerve back and forth in the water.

Documents FR 1 011 324 and U.S. Pat. No. 1,545,807 are also known. They disclose aquatic exercise devices that comprise a base arranged to be held with a foot or with a hand, and webbing, in particular in the form of a corolla.

That webbing comprises a flexible skirt and rigid fins mounted on the skirt. In addition, abutment means are arranged on the base so as to form abutments against the rigid fins while the skirt is moving.

In FR 1 011 324, the inside peripheral edge of the skirt is secured inside a peripheral edge rolled in the form of a scroll on the base, the deployment of the skirt making it possible for its inside peripheral edge to roll around the scroll-shaped edge until a rear circular portion of each of the fins comes into contact with said scroll-shaped edge and until the tension on the inside peripheral edge rolled around the scroll-shaped edge stops the rolling and thus stops the deployment of the skirt.

In U.S. Pat. No. 1,545,807, a first version consists in fastening the inside edge of the flexible skirt inside the base so as to position the fins, mounted on the flexible skirt, in the vicinity of the abutment means constituted by an outside rim on the base, the rear angular edge of each of the fins coming into abutment against said rim while the skirt is deploying. In a second version disclosed in that document, each of the fins mounted on the flexible skirt is made up of a rigid core incorporated in a flexible covering, the inside edge of said flexible covering and the inside peripheral edge of the skirt being concomitantly fastened to the inside of the metal base, so that the rear angular edge of the core comes into abutment against an outside metal rim arranged on the base.

SUMMARY OF THE INVENTION

The aquatic exercise device of the invention makes it possible to mitigate all or some of the existing drawbacks, and also constitutes a design that is an alternative to the designs of the aquatic exercise devices disclosed in Documents FR 1 011 324 and U.S. Pat. No. 1,545,807, this alternative design offering, in particular, the advantage of facilitating design and assembly of the elements of the aquatic exercise device, and of improving the hydrodynamic shape of the webbing, with a view to limiting turbulence.

To this end, the aquatic exercise device of the invention comprises a base arranged to be held in particular with a foot or with a hand, and webbing, in particular corolla-shaped webbing, that is secured to the base, that is hinged therewith, and that is suitable for deforming under pressure from the water that is exerted while the device is moving, said webbing being deployed when the device is pushed, and being closed when said device is pulled, or vice versa.

The webbing is made up of a flexible skirt and of rigid fins, the skirt being molded over the fins; this offers the advantage of obviating the need for any additional securing between the skirt and the fins, and of eliminating the presence of fins above the skirt, thereby facilitating uniform flow of water, without the flow of water being disturbed on closure of the skirt. The corolla-shaped skirt has an inside peripheral edge and an outside peripheral edge, the inside peripheral edge of the skirt being secured to an outside peripheral edge arranged on the base. The fins are distributed radially around the skirt, the inside edges of the fins being distant from the inside peripheral edge of the skirt. In this way, only the flexible skirt is secured to the base, at its outside peripheral edge, the flexibility of the skirt enabling said skirt to be deformed and to constitute the hinge via which the webbing is hinged to the base.

In addition, the base is provided with abutment means distributed over its outside peripheral edge, said abutment means being arranged to bear on the top faces of the fins when the skirt is secured to the base. Such a design offers the advantage of imparting suitable flexibility while the webbing is collapsed during the return stroke of the device, and, conversely, of imparting good rigidity to the webbing as deployed; it is thus possible to prevent the webbing from turning inside out while it is deployed and while it is opposing resistance during pushing or pulling, the risks of it turning inside out being eliminated by the abutment means on the base that bear on the rigid fins. In addition, the abutment means bearing on the top faces of the fins rather than on their rear faces, as specified in FR 1 011 324 and U.S. Pat. No. 1,545,807, offers the advantage of avoiding any tensions in the zone in which the base is secured to the skirt.

Preferably, the flexible skirt is provided with notches extending radially around said skirt, from its inside peripheral edge, said notches being disposed between the fins. Such a design improves the flexibility of the webbing and compensates for the rigidity of the fins so as to guarantee that said webbing closes appropriately, and so as to minimize the resistance of the device while it is returning to its initial position ready for a new work cycle. These notches also serve to reduce the resistance of the device in the water while the webbing is deployed, so as to limit the effort that the user needs to make during the work, and so as to stabilize said webbing by facilitating the flow of water through said notches.

Preferably and in non-limiting manner, the base is made up of two parts. The first or "bottom" part is disposed beneath the skirt, while the second or "top" part is disposed above the skirt. These parts are suitable for being assembled together, the inside peripheral edge of the skirt being held clamped between the bottom part and the top part when they are assembled together. This design advantageously facilitates assembling the skirt to the base, by guaranteeing that these elements are secured together very firmly.

In addition, the base is provided with a central handle suitable for being held with the hand or for receiving a separate part enabling it to be held with the foot.

To this end, the invention also provides an aquatic exercise kit made up of at least one aquatic exercise device of the invention that has a central handle, and of at least one support, in particular a shoe, suitable for receiving the foot of a user or some other portion of the body, said support comprising a sole and fastening means arranged on the bottom face of said sole so as to be fastened to the central handle of the base.

BRIEF DESCRIPTION OF THE DRAWINGS

Other characteristics of the present invention appear on reading the following description given with reference to the figures, in which.

DETAILED DESCRIPTION OF THE DRAWINGS

Figure 1:
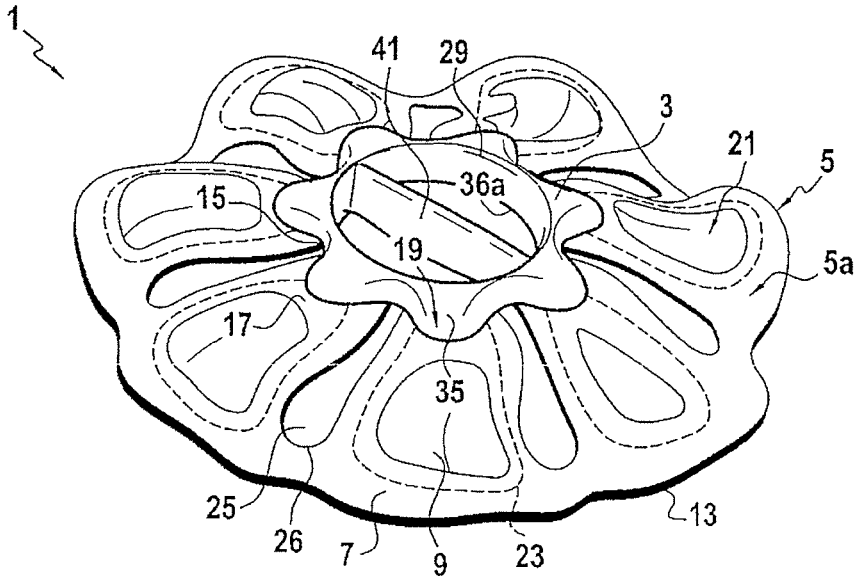
FIG. 1 is a view from above of a preferred design of an aquatic exercise device of the invention.
Figure 2:
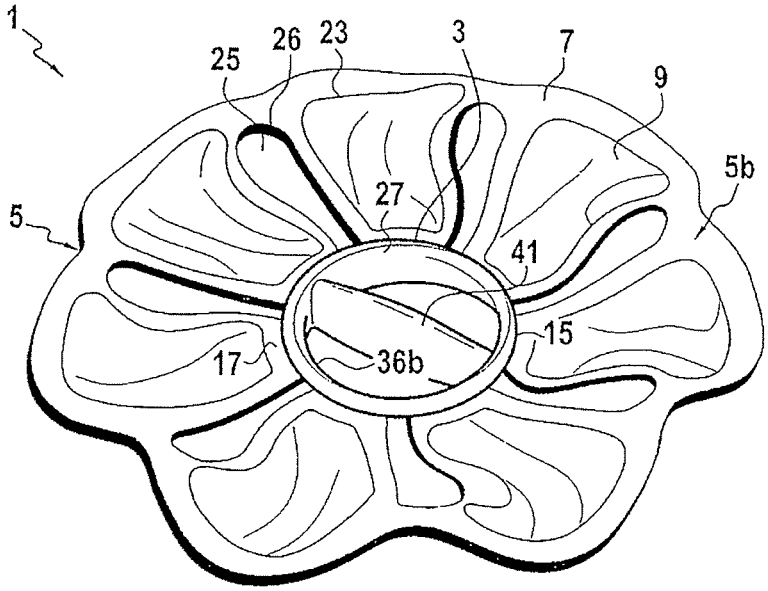
FIG. 2 is a view from below of the FIG. 1 device.

As shown in FIGS. 1 and 2, the aquatic exercise device comprises a base 3 and webbing 5 that is corolla-shaped. The webbing 5 has a top face 5*a*, shown in FIG. 1, and a bottom face 5*b*, shown in FIG. 2.

When the water exerts a pressure on the bottom face 5*b*, while the device is being pushed or pulled, depending on the direction in which said device is held with the foot or with the hand, or indeed with any other portion of the body, the webbing is then in the deployed position and opposes resistance that requires the user to make additional effort for moving said appliance through the water, while the user is doing work. Conversely, when the water exerts a pressure on the top face 5*a* of the webbing, while the device is being pushed or pulled, said webbing closes so as to enable water to flow while the device is being moved without opposing resistance, in order to enable the user not to need to make additional effort while the device is returning to its initial position ready for doing a new work cycle, which affords the user a recovery time before said user makes further muscular effort.

Figure 3:
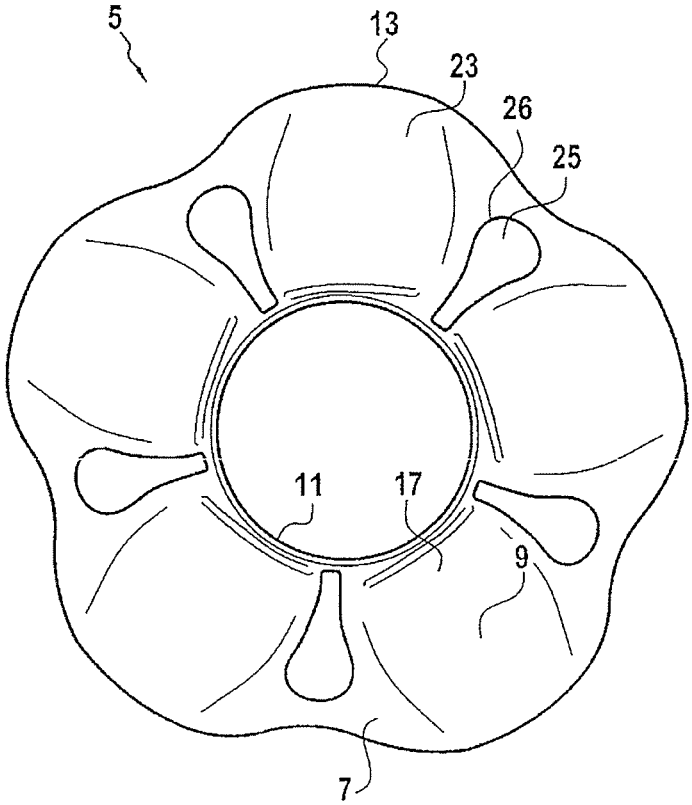
FIG. 3 shows the skirt that constitutes the webbing of the device shown in FIGS. 1 and 2.

As shown in FIGS. 1 to 3, the webbing is constituted by a skirt 7 and by fins 9. The skirt 7 is made of an elastomer material, preferably of the styrene ethylene butadiene styrene (SEBS) type, imparting flexibility to the skirt. Conversely, the fins are made of a polymer material, and in particular of polypropylene, imparting rigidity to said fins. The skirt 7 that constitutes the corolla-shape of the webbing has an inside peripheral edge 11 and an outside peripheral edge 13. The inside peripheral edge 11 is secured to the base 3 that has an outside peripheral edge 15 at which said inside peripheral edge 11 is held, as shown in FIG. 2.

In addition, the fins are distributed radially around the skirt. Preferably and in non-limiting manner, said fins 9 are disposed uniformly around the skirt 7. Preferably there are five fins, as shown in FIG. 3, or seven fins, as shown in FIGS. 1 and 2. In addition, the inside edges 17 of the fins 9 are distant from the inside peripheral edge 11 of the skirt. It is thus possible to guarantee that the base is assembled to the webbing at the skirt that has flexibility making it possible to deform the corolla in such a manner as to deploy it or to close it, without the rigidity of said fins interfering with the flexibility of the webbing during deployment or during closure thereof, the inside peripheral edge 11 of the skirt 7 acting as a hinge. In addition, the outside edges 23 of said fins 9 are disposed some distance from the outside peripheral edge 13 of the skirt, thereby making it possible for the webbing 5 to retain a certain amount of flexibility at its outside peripheral edge. It is thus possible to avoid any risk of impact on the portions of the body when the device 1 comes into contact with them unexpectedly during the exercising.

Preferably, and in non-limiting manner, the skirt 7 is provided with notches 25 that extend radially around said skirt, from its inside peripheral edge, i.e. from where the skirt is connected to the outside edge 15 of the base 3. These notches 25 are preferably petal-shaped, said petals extending from the inside peripheral edge 11 to some distance from the outside peripheral edge 13 of said skirt as shown in FIGS. 1 to 3, which distance can be of various magnitudes, the outer ends 26 of the petals substantially corresponding to the position of the outer edges of the 23 of the fins 9. In addition, said notches 25 are disposed between the fins 9. Such notches have the advantage of improving the flexibility of the webbing during closure thereof. In addition, said notches 25 that are some distance away from the outside edge 13 of the skirt 7 make it possible to keep a connection or a link between the fins 9 that is sufficiently rigid to guarantee that they are deployed simultaneously when the water exerts pressure on the bottom face 5*b* of the webbing 5, while also avoiding any risks of the skin being pinched, and, conversely, to guarantee that they are closed simultaneously when the water exerts pressure on the top face 5*a* of said webbing 5. It is however possible to design notches 25 that extend from the inside peripheral edge 11 to the outside peripheral edge 13 of the skirt, by providing an intermediate link or tie, e.g. half-way between the inside peripheral edge and the outside peripheral edge, in such a manner as to keep rigidity between said fins 9.

Preferably and in non-limiting manner, the flexible skirt 7 made of elastomer is molded over the rigid fins made of a polymer material during the process of manufacturing the webbing. This design offers the advantage of being easy to implement industrially and of guaranteeing excellent strength between the fins 9 and the skirt 7. Portions of the fins 9 may, however, be visible at the surface of the skirt 7 in order to improve the appearance of the product and in order to implement graphics or color schemes on the surface of the webbing 5. In a variant design, it is however possible to make provision for the rigid fins 9 and the flexible skirt 7 to be assembled together mechanically, said fins 9 then being fastened mechanically to the top face of said skirt 7 by adhesive bonding, clip-fastening, or any other fastening means.

FIGS. 1, 2, 4, and 5 show the base 3 of the aquatic exercise device 1 of the invention. Preferably and in non-limiting manner, said base 3 is made up of two parts 27, 29. The first part 27, shown in FIGS. 2 and 5, constitutes the bottom portion of the base 3. As shown in FIG. 2, this bottom part 27 is disposed beneath the skirt 7. The bottom part 27 has an outside peripheral edge 31 corresponding to the outside peripheral edge 15 and that is arranged to cover the inside peripheral edge 11 of the skirt 7 when it is assembled to the top part 29. In addition, said outside peripheral edge 31 of the bottom part 27 is arranged not to overlap the inside edges 17 of the fins 9, and thus not to come to bear on the bottom faces of said fins 9. Conversely, the top part 29 has an outside peripheral edge 33 that is arranged to cover the inside peripheral edge 11 of the skirt 7, and also the top surfaces of the fins 9 in a manner such as to come to bear, at least partially, on said inside edges 17, on the top sides of the fins 9. Such a design offers the advantage firstly of imparting flexibility to the webbing while it is closing by collapsing in on the bottom portion 27 of the base 3, said bottom part 27, secured to the flexible skirt 7 only, not opposing closure of the webbing 5. Conversely, while the webbing 5 is being deployed by the corolla opening, the outside peripheral edge 33 of the top part 29 bears on the top faces of the fins 9 and forms an abutment limiting the opening of the corolla. In addition, the rigidity of the fins 9 avoids any risks of the webbing 5 turning inside out.

Figure 5:
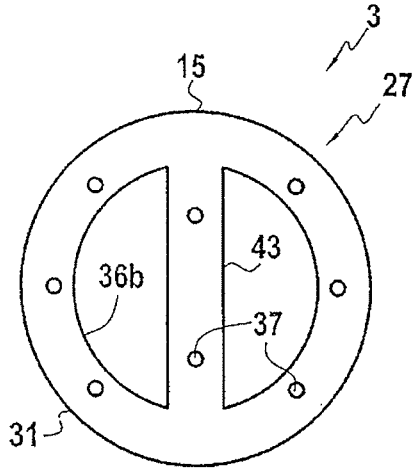
FIG. 5 shows an element constituting the bottom portion of the base.

As shown in FIG. 5, the bottom part 27 has an outside peripheral edge 31 that is of circular shape. Similarly, as shown in FIG. 3, the inside peripheral edge 11 of the skirt 7 is circular, its diameter being significantly smaller than the diameter of the outside peripheral edge 31 of the bottom part 27. In addition, the diameter of the outside peripheral edge 31 is smaller than the diameter corresponding to the position of the inside edges 17 of the fins 9.

Figure 4:
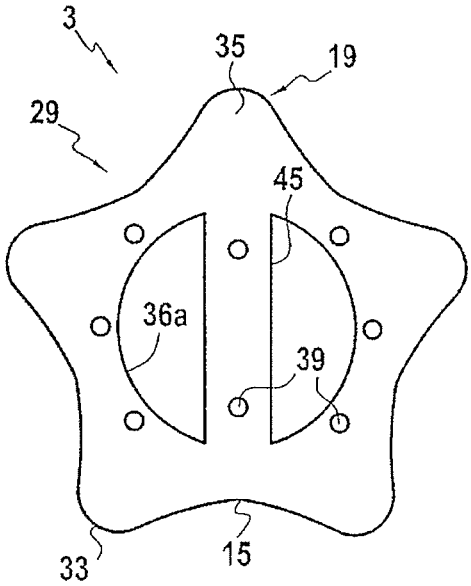
FIG. 4 shows an element that constitutes the top portion of the base.

As shown in FIG. 4, the top part 29 has an outside peripheral edge 33 that is star-shaped. The star shape has a number of branches, i.e. a number of points 35, that is equal to the number of fins 9 present on the webbing 5. Said points 35 are suitable for bearing at least on the top portions of the fins 9 when the two parts 27, 29 are assembled together.

To this end, the bottom part 27 and the top part 29 are arranged to be assembled together so that, when they are assembled together, the inside peripheral edge 11 of the skirt 7 is held clamped between said parts, namely the bottom part 27 and the top part 29.

In a variant design, it is possible to design a top part 29 that has an outside peripheral edge 33 of circular shape, rather than being star-shaped. In which case, the diameter of the outside peripheral edge 33 is larger than the diameter of the outside peripheral edge 31 of the bottom part 27, said outside peripheral edge 33 of circular shape being arranged to bear at least on the top portions of the fins 9, when the two parts, namely the bottom part 27 and the top part 29, are assembled together.

The bottom part 27 and the top part 29 both have respective inside peripheral edges 36*a*, 36*b* that are preferably of circular shape and of identical diameter, so that when the two parts are assembled together, their inside peripheral edges 36*a*, 36*b* correspond as shown in FIGS. 1 and 2.

In addition, the bottom part 27 and the top part 29 are provided with assembly clips 37, 39, shown in FIGS. 4 and 5, the clips 37 on the bottom part 27 being arranged to snap-fasten into the clips 39 on the top portion 29 so as to keep said parts assembled together. In addition, said assembly clips 37, 39 are arranged on the bottom and top parts 27, 29 in a manner such as to guarantee that the points 35 of the star shape of the top part 29 are positioned in register with the fins 9 on the webbing 5. It is possible, in addition, to provide positioning means for positioning the top part 29 or the bottom part 27 in a well-defined position on the skirt 7, by using "keying" means, so as to guarantee that the points 35 of the star shape are positioned above the top faces of the fins 9.

As shown in FIGS. 1, 2, 4, and 5, the base is provided with a central handle 41 suitable for being held with the hand or for receiving a separate part enabling it to be held with the foot. Said central handle 41 is made up of two central half-handles 43, 45, one arranged on the bottom part 27, and the other arranged on the top part 29, the two half-handles being suitable for cooperating to form the central handle 41 on clipping the two parts together. When the two parts 27, 29 are assembled together, the two central half-handles 43, 45 form the central handle 41 that is preferably of cylindrical and ergonomic shape facilitating taking hold of the device.

Figure 6:
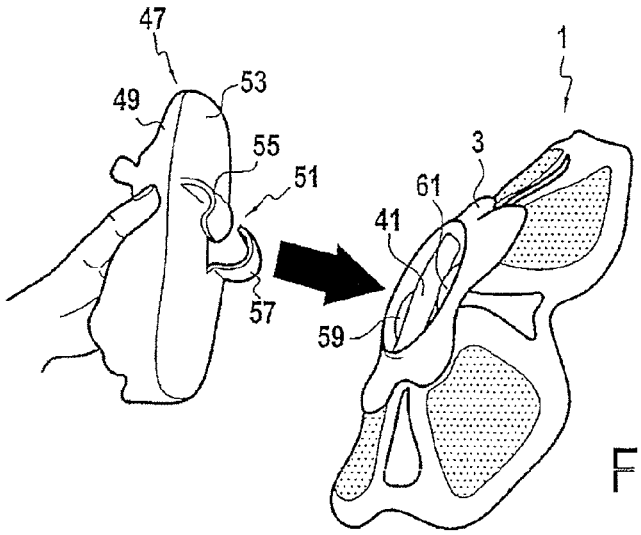
FIG. 6 shows a preferred design of an aquatic exercise kit of the invention.
Figure 7:
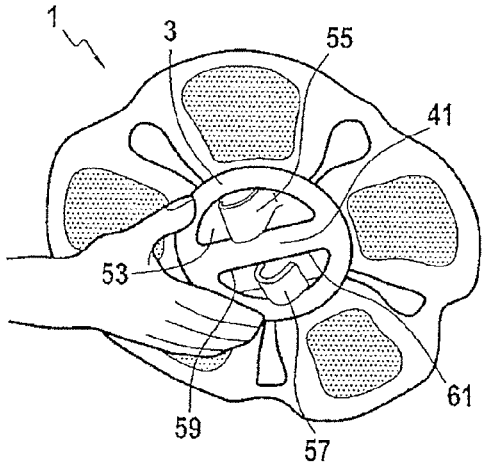
FIGS. 7 and 8 show how the shoe is assembled to the aquatic exercise device of the invention.
Figure 8:
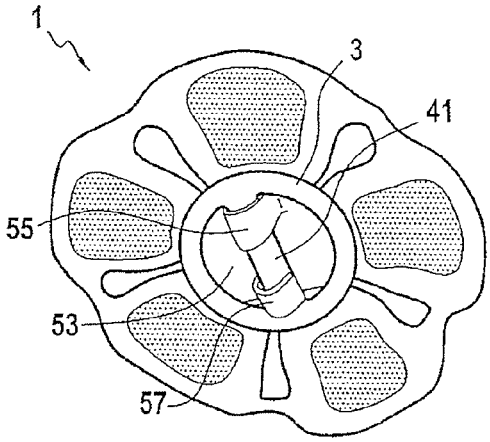

In another aspect of the invention, shown in FIGS. 6 to 8, the invention relates to an aquatic exercise kit made up of the above-described preferred embodiment of an aquatic exercise device and of a shoe adapted to doing aquatic activities, in particular as regards waterproofness. This shoe 47, shown in FIG. 6, comprises a sole 49 and fastening means 51 arranged on the bottom face 53 of the sole, which fastening means 51 are suitable for being fastened to the central handle 41. In a preferred design, the fastening means are constituted by at least one hook, and preferably by hooks 55, 57 that are curved over and suitable for snap-fastening onto the handle 41 on the base 3 of the device 1. The two hooks 55, 57 shown in FIGS. 6 to 8 are offset and the other way round from each other, the curved-over portion of each of the hooks 55, 57 having a diameter corresponding to the diameter of the handle 41 on the base. In addition, the offset between the two hooks is arranged so that, on assembling together the shoe 47 and device 1, the two hooks 55, 57 penetrate through the two openings 59, 61 formed between the inside peripheral edge 36*a*, 36*b* of the base and the handle 41, as shown in FIG. 7. Then, by moving the shoe 47 in rotation relative to the base 3, the two hooks 55, 57 are caused to pivot so that they snap-fasten onto said handle 41, as shown in FIG. 8, thereby securing the shoe 47 to the device 1. The user then places the foot in the shoe for doing aquatic exercises with the legs.

In addition, the cylindrical and ergonomic shape of the handle 41 on the base 3 preferably includes two zones 59, 61 of slight narrowing in its diameter that correspond to the locations for receiving the hooks 55, 57, these slightly narrower zones 59, 61, shown in FIG. 7, making it possible to hold the hooks 55, 57 of the shoe stationary as snap-fastened to the handle 41.

The aquatic exercise kit is made up of a shoe 47 and of a device 1 as described above. It is, however, possible to provide an aquatic exercise kit made up of two aquatic exercise devices 1 of the invention and of a pair of left and right shoes 47. It is also possible to provide a kit made up of four aquatic exercise kits 1 of the invention and of one pair of shoes 47, this kit making it possible do aquatic exercise simultaneously with both legs and with both arms, the user holding two aquatic exercise devices 1 with the left and right hands, and the other two devices 1 being fastened by means of the shoes 47 to the left and right feet.

The invention claimed is:

1. An aquatic exercise device comprising a base arranged to be held with a foot or with a hand, and corolla-shaped webbing, that is secured to the base and that is suitable for deforming under pressure from the water that is exerted while the device is moving, said webbing being deployed when the device is pushed, and being closed when said device is pulled, or vice versa, said aquatic exercise device, wherein the webbing is made up of corolla-shaped flexible skirt and of rigid fins, the skirt being overmolded with the fins and having an inside peripheral edge and an outside peripheral edge, the inside peripheral edge of the skirt being secured to an outside peripheral edge arranged on the base, the fins being distributed radially around the skirt, the inside edges of the fins being distant from the inside peripheral edge of the skirt, and in that the base is provided with abutment means distributed over its outside peripheral edge, said abutment means being arranged to bear on the top faces of the fins, and wherein the base is made up of two parts, namely a "bottom" part that is disposed beneath the skirt, and a "top" part that is disposed above the skirt, said parts begin suitable for being assembled together, the inside peripheral edge of the skirt being held clamped between the bottom part and the top part when they are assembled together.

2. An aquatic exercise device comprising a base arranged to be held with a foot or with a hand, and webbing, that is secured to the base and that is suitable for deforming under pressure from the water that is exerted while the device is moving, said webbing being deployed when the device is pushed, and being closed when said device is pulled, or vice versa, said aquatic exercise device, wherein the webbing is a corolla-shaped webbing made up of corolla-shaped flexible skirt and of rigid fins overmolded with the corolla-shaped flexible skirt and having an inside peripheral edge and an outside peripheral edge, the inside peripheral edge of the skirt being secured to an outside peripheral edge arranged on the base, the fins being distributed radially around the skirt, the inside edges of the fins being distant from the inside peripheral edge of the skirt, and in that the base is provided with abutment means distributed over its outside peripheral edge, said abutment means being arranged to bear on the top faces of the fins.

3. A device as in claim 2, wherein the base comprises a central handle suitable for being held with the hand.

4. A device according to claim 2, wherein the outside edges of the fins are disposed some distance from the outside peripheral edge of the skirt.

5. A device according to claim 2 wherein the skirt is provided with notches extending radially around the skirt, from its inside peripheral edge, said notches being disposed between the fins.

6. A device according to claim 5, wherein the notches are petal-shaped, the petals extending from the inside peripheral edge of the skirt to a distance close to the outside peripheral edge of said skirt, in such a manner as to keep a connection between the fins that is sufficiently rigid to guarantee that said fins are opened or closed simultaneously.

7. A device according to claim 2, wherein the skirt is made of an ethylene butadiene styrene (SEBS) elastomer material, and the fins are made of a polypropylene polymer material.

8. A device according to claim 2, wherein the base is made up of two parts, namely a "bottom" part that is disposed beneath the skirt, and a "top" part that is disposed above the skirt, said parts begin suitable for being assembled together, the inside peripheral edge of the skirt being held clamped between the bottom part and the top part when they are assembled together.

9. A device according to claim 8, wherein the bottom part has an outside peripheral edge arranged to cover the insider peripheral edge of the skirt when said bottom part and said top part are assembled together, said top part also having an outside peripheral edge arranged to cover the inside peripheral edge of the skirt and to bear at least partially on the top portions of the fins.

10. A device according to claim 9, wherein the inside peripheral edge of the skirt is circular, in that the outside peripheral edge of the bottom part is circular, the diameter of the inside peripheral edge of the skirt being significantly smaller than the diameter of the outside peripheral edge of the bottom part.

11. A device according to claim 10, wherein the outside peripheral edge of the top part is star-shaped, the star shape having a number of points equal to the number of fins of the webbing, said points being suitable for bearing at least on the top portions of the fins when the two parts are assembled together.

12. A device according to claim 10, wherein the outside peripheral edge of the top part is circular shape, of diameter larger than the diameter of the outside peripheral edge of the bottom part, said outside peripheral edge being suitable for coming to bear at least on the top portions of the fins, when the two parts are assembled together.

13. A device according to claim 8, wherein the bottom part and the top part are provided with assembly clips suitable for keeping said parts assembled together.

14. A device according to claim 11, wherein the bottom part and the top part are provided with assembly clips suitable for keeping said parts assembled together.

15. A device according to claim 14, wherein the assembly clips are arranged on the bottom part and the top part so as to guarantee that the points of the star shape of said top part are positioned in register with the fins on the webbing.

16. A device according to claim 2, wherein the base is provided with a central handle for receiving a separate part enabling it to be held with the foot.

17. A device according to claim 8, wherein each of the two parts, namely the bottom part and the top part, has a central half-handle, said half-handles being suitable for forming a central handle suitable for being held with the hand or for receiving a separate part enabling it to be held with the foot when said two parts are assembled together.

18. An aquatic exercise kit made up of at least one aquatic exercise device according to claim 17, and of at least one support suitable for receiving the foot of a user or some other portion of the body, said support comprising a sole and fastening means arranged on the bottom face of said sole so as to be fastened to the central handle.

19. A kit according to claim 18, wherein the fastening means comprise at least one curved-over hook suitable for snap-fastening to the central handle.

20. A kit according to claim 19, wherein the fastening means are made up of two hooks that are curved over and that are the other way round from each other, said hooks being suitable for snap-fastening to the central handle.

* * * * *